US006476841B1

(12) United States Patent
Miyano

(10) Patent No.: US 6,476,841 B1
(45) Date of Patent: Nov. 5, 2002

(54) THERMAL TRANSFER PRINTER

(75) Inventor: Tsuyoshi Miyano, Sunnyvale, CA (US)

(73) Assignee: ALPS Electric Co., Ltd., Tokyo (JP)

( * ) Notice: Subject to any disclaimer, the term of this patent is extended or adjusted under 35 U.S.C. 154(b) by 0 days.

(21) Appl. No.: 09/964,931

(22) Filed: Sep. 26, 2001

(51) Int. Cl.[7] ..... B41J 2/325
(52) U.S. Cl. ..... 347/213
(58) Field of Search ..... 347/172, 173, 347/213, 174, 176; 400/120.01, 120.02

(56) References Cited

FOREIGN PATENT DOCUMENTS

JP 6-262784 * 9/1994 ..... 347/213
JP 08-118693 5/1996
JP 10-175375 6/1998

* cited by examiner

*Primary Examiner*—Huan Tran
(74) *Attorney, Agent, or Firm*—Beyer Weaver & Thomas, LLP

(57) ABSTRACT

A thermal transfer printer is described. The thermal transfer printer includes a transfer roller, a first platen, a thermal transfer printing section, and a second platen. The transfer roller is operable to heat first ink for transfer of the first ink from a first ink film to a printing medium. The transfer roller presses the first ink film and the printing medium against the first platen. The thermal transfer printing section is operable to heat second ink for transfer the second ink from a second ink film to the printing medium. The thermal transfer printing section presses the second ink film and the printing medium against the second platen.

4 Claims, 2 Drawing Sheets

THERMAL TRANSFER PRINTER

BACKGROUND OF THE INVENTION

The present invention relates to printers, and more specifically, to apparatus and methods for printing a metallic layer and a regular color layer.

Thermal printers are used for printing various documents including personal identification cards. Typically, these identification cards have images on their surfaces printed in various colors. Some cards have images printed in metallic color.

In the prior art, there are thermal printers that print on a printing medium in regular colors such as cyan, magenta, yellow, and black and white. In order to print a background layer on the printing medium, a separate pre-printing process for applying a metallic layer on the medium is necessary. However, the application of the metallic layer poses some problems. For example, the metallic printing prior to the regular color printing inevitably incurs some lead time between the two printing steps. Furthermore, it is difficult to keep surfaces printed in metallic colors clean until the time when the regular color printing is performed on the metallic layer.

In view of these and other issues, it would be desirable to have a technique allowing a thermal transfer printer to print in metallic colors and regular colors efficiently and inexpensively.

SUMMARY OF THE INVENTION

According to various embodiments of the present invention, a thermal transfer printer includes a roller printing section for transferring metallic ink to a printing medium as a background layer, and a thermal transfer printing section for printing images by transferring regular color ink to the top of the background layer. Thus, the embodiments are capable of efficiently transferring a metallic ink layer to the whole area of a printing medium, and then transferring images using regular color ink on the metallic ink layer.

In some embodiments, the roller printing section includes a transfer roller and a first platen. The transfer roller is operable to heat metallic ink on a metallic ink film for transfer of metallic ink from a metallic ink film to a printing medium. The transfer roller presses the metallic ink film and the printing medium against the first platen. The thermal transfer printing section is operable to heat the regular color ink for transfer the regular color ink from a regular color ink film to the printing medium. The thermal transfer printing section presses the regular color ink film and the printing medium against a second platen.

In some specific embodiments, the thermal transfer printing section includes an intermediate transfer film, a print head, and an intermediate transfer roller. The print head has a plurality of resistance heating elements for transfer of the regular color ink from the regular color ink film to the intermediate transfer film. The intermediate transfer roller is operable to heat the regular color ink on the intermediate transfer film for transfer of the regular color ink from the intermediate transfer film to the printing medium.

A further understanding of the nature and advantages of the present invention may be realized by reference to the remaining portions of the specification and the drawings.

BRIEF DESCRIPTION OF THE DRAWING

The invention, together with further objects and advantages thereof, may best be understood by reference to the following description taken in conjunction with the accompanying drawings in which.

DETAILED DESCRIPTION OF SPECIFIC EMBODIMENTS

Various embodiments of the present invention will now be described in detail with reference to the drawings, wherein like elements are referred to with like reference labels throughout.

Various embodiments of the present invention (i) transfer metallic ink to a printing medium as a background layer by utilizing a "roller printing" section, and then (ii) print images by transferring regular color ink to the top of the background layer by utilizing a "thermal transfer printing" section. Thus, the embodiments enables efficient transfer of a metallic ink layer to the whole area of a printing medium, and transfer of images using regular color ink on the metallic ink layer.

In this specification, "metallic ink" includes any ink which includes metallic substance such as metallic powder, metallic film or the like. Thus, the metallic ink includes, for example, gold color ink, silver color ink, and bronze (or copper) color ink. Similarly, a "metallic ink film" includes any ink film which carries metallic ink thereon. Thus, the metallic ink film includes metallic substance such as metallic powder, metallic film or the like. "Regular color ink" means any ink other than the metallic ink, which includes, for example, cyan ink, magenta ink, yellow ink, black ink, and white ink. A "regular color ink film" includes any film which carries regular color ink thereon.

Also, in this specification, an "ink film" includes any ink film which carries metallic ink or regular color ink. Thus, the ink film includes an ink film 122, regular color ink films 140 and 240, and an intermediate transfer film 148 described in detail below referring to FIGS. 1 and 2.

Figure 1:
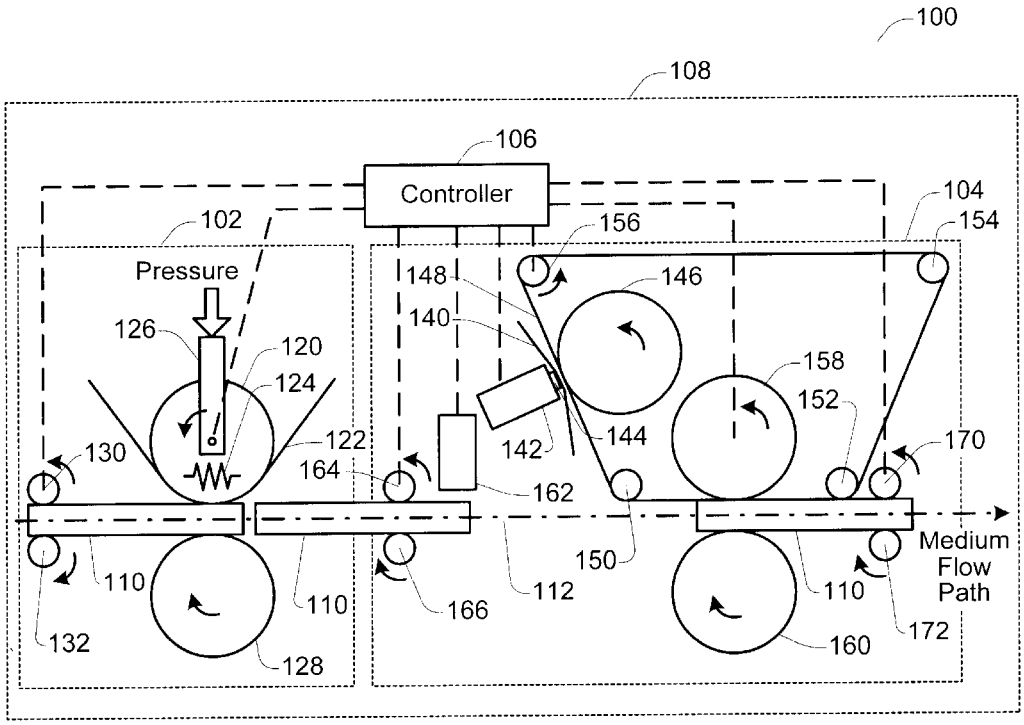
FIG. 1 is cross-sectional view of a thermal transfer printer of a specific embodiment according to the present invention.

FIG. 1 is a cross-sectional view of a thermal transfer printer 100 of a specific embodiment according to the present invention. The thermal transfer printer 100 includes a roller printing section 102, a thermal transfer printing section 104, and a controller 106 within a housing 108. A printing medium 110 is fed along a medium flow path 112 from left to right in FIG. 1. FIG. 1 shows three locations of the printing medium 110 in the thermal transfer printer 100.

Suitable polymers for the printing medium 110 include polyvinylchloride (PVC), polycarbonate (PC), acrylonitrile-butadiene-styrene (ABS), polypropylene sulfate (PPS), and polyethylene terephthalate glycol (PETG). Circles shown in FIG. 1 represent rollers or platens, and elongated rectangulars 110 in FIG. 1 represent cards or plate-like materials used as the printing medium 110.

The roller printing section 102 includes a transfer roller 120 which is operable to heat metallic ink on the ink film 122, thereby transferring the metallic ink from the ink film 122 to the printing medium 110. In order to heat the metallic ink, the transfer roller 120 has a heater 124 therein. In order to apply pressure to the ink film 122 and the printing medium 110, the transfer roller 120 is mechanically coupled to a pressure mechanism 126 which presses the transfer roller 120 against a platen 128. The pressure mechanism 126 includes, for example, a spring. Thus, the transfer roller 120 presses the ink film 122 and the printing medium 110 against the platen 128. The ink film 122 includes at least one of a gold color layer, a silver color layer, and a bronze color layer on a base film. The base film is made from plastic materials including polyethylene terephthalate (PET).

The platen 128 included in the roller printing section 102 in this specific embodiment is a roller having a rubber layer thereon. However, the platen 128 may be any other suitable type of platen including a flat platen. Feeding rollers 130 and 132 feed the printing medium 110 onto the transfer roller 120 and the platen 128 along the medium flow path 112. The controller 106 controls rotational speeds and directions of the transfer roller 120 and the feeding roller 130 appropriately.

The thermal transfer printing section 104 is operable to heat regular color ink on the regular color ink film 140 for transfer the regular color ink from the regular color ink film 140 to the printing medium 110. The regular color ink film 140 includes at least one of a cyan color layer, a magenta color layer, a yellow color layer, a black color layer, and a white color layer on a base film. The base film is made from plastic materials including polyethylene terephthalate (PET).

The thermal transfer printing section 104 includes a printing head 142 having a plurality of resistance heating elements 144, and a platen 146. The resistance heating elements 144 apply heat to the regular color ink film 140 based on electric drive pulses representing image data. The printing head 142 presses the regular color ink film 140 and the intermediate transfer film 148 against the platen 146, thereby transferring the regular color ink to the intermediate transfer film 148 by heat and pressure. The intermediate transfer film 148 constitutes a closed loop, which rotates counterclockwise in FIG. 1 supported by feeding rollers 150, 152, 154 and 156.

The regular color ink transferred from the regular color ink film 140 to the intermediate transfer film 148 is carried counter clockwise to a point where an intermediate transfer roller 158 and a platen 160 contact the printing medium 110. In order to determine the exact position of the printing medium 110, the thermal transfer printing section 104 includes a sensor 162 which detects a predetermined point on the printing medium 110 by utilizing, for example, an optical sensing technique. Feeding rollers 164 and 166 feed the printing medium 110 onto the intermediate transfer roller 158 and the platen 160 along the medium flow path 112. The controller 106 controls rotational speeds and directions of the feeding roller 164 appropriately.

The printing medium 110 is positioned on a predetermined point on the medium flow path 112 by using the sensor 162 and the feeding roller 164 controlled by the controller 106. Then, the feeding rollers 164 and 166 feed the printing medium 110 onto the intermediate transfer roller 158 and the platen 160 along the medium flow path 112. The intermediate transfer roller 158 presses the intermediate transfer film 148 and the printing medium 110 against the platen 160, thereby transferring the regular color ink from the intermediate transfer film 148 to the printing medium 110 by pressure. Feeding rollers 170 and 172 feed the printing medium 110 out of the housing 108 of the thermal transfer printer 100 along the medium flow path 112. The controller 106 controls rotational speeds and directions of the feeding rollers 170 and 172 appropriately.

Figure 2:
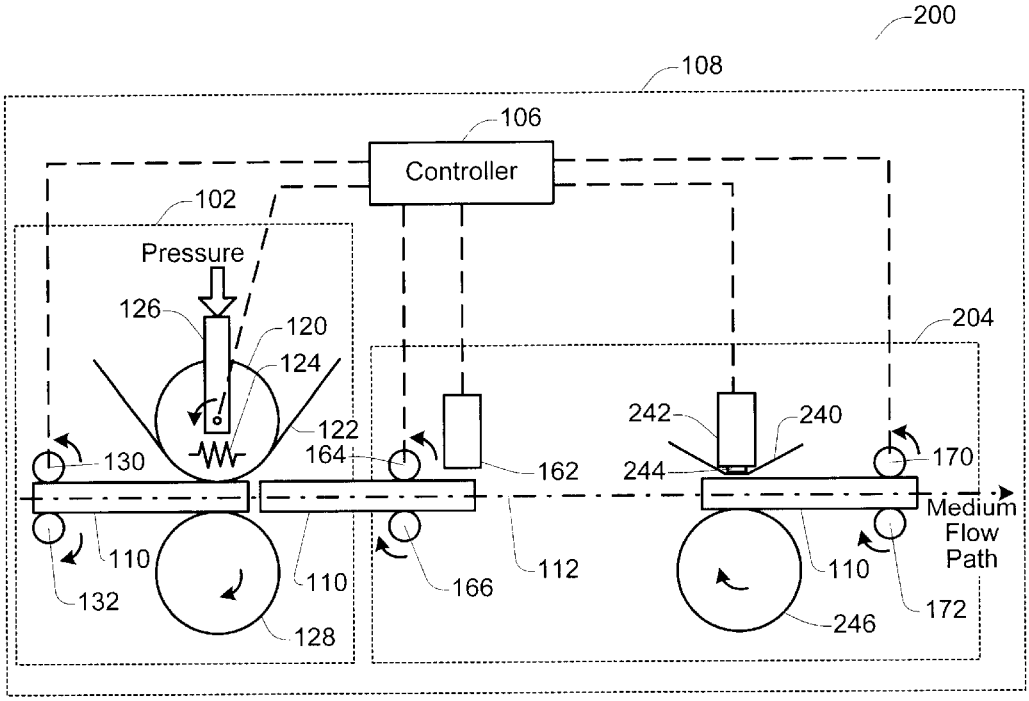
FIG. 2 is a cross-sectional view of a thermal transfer printer of an alternative embodiment according to the present invention.

FIG. 2 is a cross-sectional view of a thermal transfer printer 200 of an alternative embodiment according to the present invention. The thermal transfer printer 200 includes the roller printing section 102, a thermal transfer printing section 204, and the controller 106 within the housing 108. The differences between the embodiments shown in FIGS. 1 and 2 mainly reside in the thermal transfer printing section 204. Thus, it should be appreciated that elements in FIG. 2 which are assigned the same reference labels as shown in FIG. 1 have the same functionalities as those of FIG. 1 with the exception that the elements are designed to be coordinated with the thermal transfer printing section 204.

The thermal transfer printing section 204 is operable to heat regular color ink on the regular color ink film 240 for transfer the regular color ink from the regular color ink film 240 to the printing medium 110. The regular color ink film 240 includes at least one of a cyan color layer, a magenta color layer, a yellow color layer, a black color layer, and a white color layer on a base film, which is made from plastic materials including PET.

The thermal transfer printing section 204 includes a printing head 242 having a plurality of resistance heating elements 244, and a platen 246. The resistance heating elements 244 apply heat to the regular color ink film 240 based on electric drive pulses representing image data. The printing head 242 presses the regular color ink film 240 and the printing medium 110 against the platen 246, thereby transferring the regular color ink from the regular color ink film 240 to the printing medium 110 by heat and pressure.

In the above-described embodiments referring to FIGS. 1 and 2, the transfer roller 120 is positioned upstream relative to the thermal transfer printing sections 104 and 204 along the medium flow path 112 of the printing medium 110. Such an arrangement may be desirable where, for example, the metallic ink on the ink film 122 is printed on the printing medium 110 first, and then the regular color ink on the regular color ink films 140 and 240 is printed on the printing medium 110 since the thermal transfer printers 100 and 200 can efficiently print the metallic ink as a background layer on the whole surface of one side of the printing medium 110.

Figure 3:
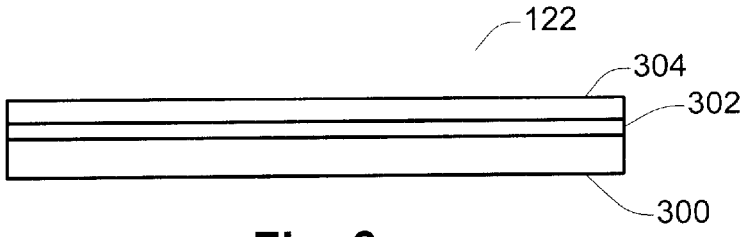
FIG. 3 is a cross-sectional view of a specific example of the ink film used for the embodiments of the thermal transfer printer according to the present invention described referring to FIGS. 1 and 2.

FIG. 3 is a cross-sectional view of a specific example of the ink film 122 used for the embodiments of the thermal transfer printer according to the present invention described referring to FIGS. 1 and 2. The ink film 122 includes a base film 300, an adhesive layer 302, and a metallic color layer 304. The base film is made from plastic materials such as PET. The adhesive layer 302 is interposed between the base film 300 and the metallic color layer 304 for affixing the metallic color layer 304 to the base film 300. The metallic color layer 304 includes at least one of a gold color layer, a silver color layer, and a bronze color layer, each of which contains metallic powder exhibiting the corresponding metallic color. In an alternative embodiment, the ink film 122 includes an opaque layer on the adhesive layer 302 instead of the metallic color layer 304.

Figure 4:
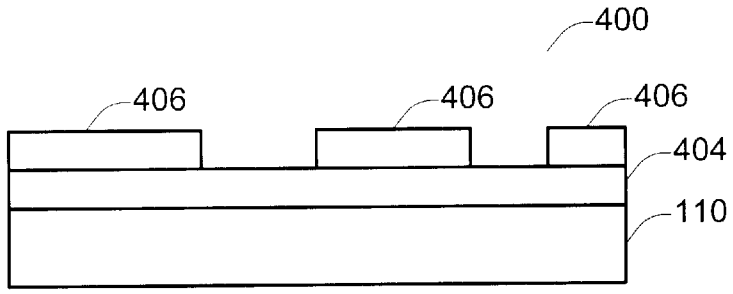
FIG. 4 is cross-sectional view of a card during the printing process utilizing a specific embodiment of the method according to the present invention.

FIG. 4 is a cross-sectional view of a card 400 during the printing process utilizing a specific embodiment of the method according to the present invention. Before the printing process utilizing the thermal transfer printers 100 and 200, the card 400 includes only the printing medium 110. The specific embodiment of the method according to the present invention will now be described referring to FIGS. 1, 4 and 5.

First, the thermal transfer printer 100 receives the card 400 from an opening provided on the housing 108. The feeding rollers 130 and 132 feed the card 400 onto the transfer roller 120 and the platen 128 along the medium flow path 112. Next, the transfer roller 120 transfers the metallic color layer 304 from the ink film 122 to an upper surface of the printing medium 110 of the card 400. A transferred metallic color layer 404 is affixed to the printing medium 110 by heat and pressure applied by the transfer roller 120, the heater 124, and the platen 128. Then, an adhesive layer 406 is applied to a surface of the transferred metallic color layer 404 for improving adhesiveness between the transferred metallic color layer 404 and regular color layers printed on the transferred metallic color layer 404.

Figure 5:
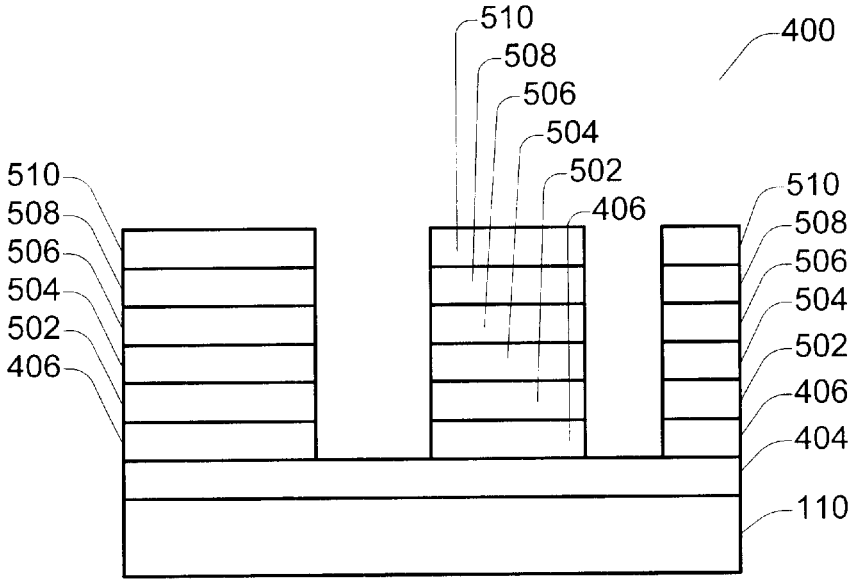
FIG. 5 cross-sectional view of the card after the printing process utilizing a specific embodiment of the method according to the present invention.

FIG. 5 is a cross-sectional view of the card 400 after the printing process utilizing a specific embodiment of the method according to the present invention. After printing the metallic color layer 404, the feeding rollers 164 and 166 feed the card 400 onto the intermediate transfer roller 158 and the platen 160 along the medium flow path 112. The card 400 is positioned on a predetermined point on the medium flow path 112 by using the sensor 162 and the feeding roller 164 controlled by the controller 106. Then, the feeding rollers 164 and 166 feed the card 400 onto the intermediate transfer roller 158 and the platen 160 along the medium flow path 112. The intermediate transfer roller 158 presses the intermediate transfer film 148 and the card 400 against the platen 160, thereby transferring a cyan color layer 502, a magenta color layer 504, a yellow color layer 506, a black color layer 508, and a white color layer 510 from the intermediate transfer film 148 to a surface of the adhesive layer 406. The order of printing the regular color layers may be modified based on the color layer materials used. It should be appreciated that one or more layers among the cyan color layer 502, the magenta color layer 504, the yellow color layer 506, the black color layer 508, and the white color layer 510 may be omitted to be printed on the card 400.

The specific embodiment of the method according to the present invention described above referring to FIGS. 1, 4 and 5 can be implemented by utilizing the thermal transfer printer 200 illustrated in FIG. 2 in a similar manner except that the regular color printing is performed by the thermal transfer printing section 204 rather than the thermal transfer printing section 104. Thus, further detail is omitted.

In the specific embodiments described above, the regular color printing by the thermal transfer printing sections 104 and 204 can be implemented by a single thermal head. However, it should be appreciated that a plurality of thermal heads can be used for the regular color printing.

In the specific embodiments described above, the image layer printing by the thermal transfer printing sections 104 and 204 can be implemented by a single thermal head. However, it should be appreciated that a plurality of thermal heads can be used for the regular color printing. For example, five separate thermal heads can be used for five colors (e.g., cyan, magenta, yellow, and black and white) for the thermal transfer printing sections 104 and 204.

In the above-described specific embodiments of the thermal transfer printer according to the present invention described referring to FIGS. 1 and 2, the feeding rollers 130, 132, 164, 166, 170 and 172 are appropriately positioned along the medium flow path 112 so that the position of the printing medium 110 is controlled to go back and forth along the medium flow path 112 based on a specific printing process (e.g., watermark layer printing, image layer printing, and opaque layer printing) which is applied to the printing medium 110.

In the above embodiments of the thermal transfer printer according to the present invention described referring to FIGS. 1 and 2, the controller 106 can be implemented by any combination of software and/or hardware. For example, the controller 106 can be implemented by a microprocessor, a memory device which stores instruction codes and data, and an interface which drives external devices such as the feeding rollers, the transfer roller, and the intermediate transfer roller.

In the above embodiments of the thermal transfer printer according to the present invention described referring to FIGS. 1 and 2, the roller printing section 102 utilizes the transfer roller 120 for transfer of the metallic ink. However it should be appreciated that any suitable thermal transfer printing mechanism may be used for the roller printing section 102. Such a mechanism includes, for example, the thermal transfer printing section 104 using the intermediate transfer film 148, and the thermal transfer printing section 204 using the printing head 242 having the resistance heating elements 244.

Although only a few embodiments of the present invention have been described in detail, it should be understood that the present invention may be embodied in many other specific forms without departing from the spirit or scope of the invention. For example, although the illustrated embodiments have been described primarily in the context of a thermal transfer printer for printing images on a plastic card, it should be appreciated that various materials may be used for embodiments of the thermal transfer printer according to the present invention. Therefore, it should be apparent that the above described embodiments are to be considered as illustrative and not restrictive, and the invention is not to be limited to the details given herein, but may be modified within the scope of the appended claims.

What is claimed is:

1. A thermal printer for transferring first ink from a first ink film to a printing medium, and transferring second ink from a second ink film to the printing medium, comprising:

a transfer roller operable to heat the first ink for transfer of the first ink from the first ink film to the printing medium;

a first platen against which the transfer roller presses the first ink film and the printing medium;

a thermal transfer printing section operable to heat the second ink for transfer the second ink from the second ink film to the printing medium; and a second platen against which the thermal transfer printing section presses the second ink film and the printing medium, wherein the transfer roller is positioned upstream relative to the thermal transfer printing section along a medium flow path of the printing medium, and wherein the thermal transfer printing section includes an intermediate transfer film, a print head having a plurality of resistance heating elements for transfer of the second ink from the second ink film to the intermediate transfer film, and an intermediate transfer roller operable to heat the second ink on the intermediate transfer film for transfer of the second ink from the intermediate transfer film to the printing medium.

2. The thermal printer of claim 1, wherein the intermediate transfer film constitutes a closed loop.

3. The thermal printer of claim 2, wherein the transfer roller and the first platen apply heat and pressure to the first ink film for transfer of metallic ink.

4. The thermal printer of claim 3, wherein the intermediate transfer roller and the second platen apply heat and pressure to the second ink film for transfer of regular color ink.

* * * * *